US005087266A

United States Patent [19]

Connell et al.

[11] Patent Number: 5,087,266

[45] Date of Patent: Feb. 11, 1992

[54] METHOD FOR THE TREATMENT OF WOOL

[75] Inventors: David L. Connell, Western Underwood; Kenneth M. Huddlestone, Nr. Nottingham; Anthony Szpala, Ripley, all of England

[73] Assignee: Precision Processes (Textiles) Limited, Ambergate, United Kingdom

[21] Appl. No.: 268,549

[22] Filed: Nov. 7, 1988

[30] Foreign Application Priority Data

Nov. 5, 1987 [GB] United Kingdom ..... 8725921

[51] Int. Cl.[5] ..... D06M 15/38

[52] U.S. Cl. ..... 8/109; 8/108.1; 8/107; 8/128.1; 8/128.3

[58] Field of Search ..... 8/115.6, 108.1, 107, 8/128.1, 128.3, 109

[56] References Cited

U.S. PATENT DOCUMENTS 4,137,179 1/1979 Koerner et al. ..... 8/115.6
4,182,682 1/1980 Koerner et al. ..... 8/115.6

FOREIGN PATENT DOCUMENTS 0129322 12/1984 European Pat. Off. .
2726108 1/1978 Fed. Rep. of Germany .
2942786 5/1980 Fed. Rep. of Germany .
3503457 8/1986 Fed. Rep. of Germany .
1062564 3/1967 United Kingdom .
1213745 11/1970 United Kingdom .
1411082 10/1975 United Kingdom .
2082215 3/1982 United Kingdom .

*Primary Examiner*—Prince E. Willis
*Assistant Examiner*—John F. McNally
*Attorney, Agent, or Firm*—Wenderoth, Lind & Ponack

[57] ABSTRACT

A method for the treatment of wool so as to impart shrink resistance comprising the steps of:

i) subjecting the wool to an oxidative pretreatment, and ii) subsequently treating the wool with a) an amino functional polymer which itself confers a degree of shrink resistance and b) a silicone polymer capable of reacting with the reactive groupings of the amino functional polymer, so as to cause the polymers a) and b) to be applied to the wool fibers.

The wool thus treated also has good rub fastness when dyed and a soft handle.

9 Claims, No Drawings

METHOD FOR THE TREATMENT OF WOOL

This invention relates to a method for the treatment of wool so as to impart shrink resistance. The wool thus treated also has good rub fastness when dyed and soft handle, thereby avoiding the necessity of using an additional softening agent.

Many ways of rendering wool shrink resistant are known. Typically, these involve subjecting the wool to an oxidative treatment, either alone or followed by a polymer treatment. The latter type of two-step treatment has become very popular and is now the major process used throughout the world.

Various two-step shrink-proofing processes in which wool is treated first with an oxidative chlorinating agent and subsequently with a pre-formed synthetic polymer have been developed. A wide variety of polymers can be used in aqueous solution or dispersion, including polyamide-epichlorohydrin resins and polyacrylates. A review of work in this field by J. Lewis appears in Wool Science Review, May 1978, pages 23–42. British Patent Nos. 1,074,731 and 1,340,859 and U.S. Pat. Nos. 2,926,154 and 2,961,347 describe two-step shrink-proofing processes and resins or polymers suitable for use therein. These polymers are typically reactive polyamides. The polyamides can be derived from a polyalkylene polyamine and a dicarboxylic acid, e.g. diethylenetriamine and adipic acid, and are prepared by reaction with epichlorohydrin.

British Patent No. 1,411,082 relates to a process for shrink-proofing wool which comprises an oxidative pretreatment followed by the application of an aqueous composition comprising a minor proportion of a water-soluble cationic resin and a major proportion of dispersed particles of an acrylic copolymer capable of reaction with the cationic resin. There is no suggestion to use a silicone polymer in the process. Softening agents containing silicone polymers are known and these have been used with cotton and also with wool. However, they are only applied after the dyeing operation.

These conventional two-step processes confer good levels of shrink resistance but, despite achieving considerable commercial success, they do have significant disadvantages. It will be appreciated that the polymer is added to the oxidised wool to supplement the shrink resistance imparted by the oxidative pretreat, which may thus not be as severe as would be needed if this were the only treatment used to achieve the shrink resistance. The application of polymers, however, usually results in wool which has an undesirably harsh handle. To overcome this problem a softening agent is customarily employed during subsequent processing of the wool. Further, if the wool which has been treated with polymer is then dyed, the resulting rub fastness is generally inferior. This is particularly evident with certain dyestuffs commonly used in the wool industry. In general, it is found that the softening agents which are used to improve the handle of the wool will either exacerbate the poor rub fastness or are removed during the dyeing operation.

In addition to the rub fastness problems, polymer treated wool tops may become hard and matted on dyeing due to a delayed curing of the polymer system which has been applied. In order to avoid this, the tops have to be dried at temperatures above those necessary merely to remove moisture. This results in an excessive use of energy and a greater risk of yellowing during drying. European Patent Application No. 0129322 A provides a solution to the drying temperature problem by presenting a polymer system which crosslinks at very much lower temperatures. However, this polymer still requires the use of a softener in order to achieve the most acceptable handle.

The present invention seeks to provide a method for the treatment of wool which not only confers good levels of shrink resistance, but also gives excellent dye fastness properties and a soft handle even without the use of additional softening agents.

According to the present invention there is provided a method for the treatment of wool so as to impart shrink resistance comprising the steps of:

i) subjecting the wool to an oxidative pretreatment, and ii) subsequently treating the wool with a) an amino functional polymer which itself confers a degree of shrink resistance and b) a silicone polymer capable of reacting with the reactive groupings of the amino functional polymer, so as to cause the polymers a) and b) to be applied to the wool fibres.

The amino functional polymer and the silicone polymer may be applied to the wool together (co-application) or the silicone polymer may be applied after the amino functional polymer (post-application). If desired, the polymers may be applied to the wool in a combination of co-application and post-application techniques.

As previously mentioned, the oxidative pretreatment is a conventional procedure and a number of suitable treatments are well known. For example, the wool could be treated with permonosulphuric acid. More preferably, however, a chlorinated oxidative pretreatment is employed and this might typically involve the use of chlorine gas. Chlorinating agents such as hypochlorite or sodium dichloroisocyanurate may also be employed, (optionally together with potassium permanganate or permonosulphate), typically at levels of 0.25–2.0% active chlorine by weight on the weight of the dry wool (o.w.w.), most preferably 0.5–1.2%. The optimum level of chlorine employed is generally dependent upon the level of polymer used in the next stage of the process. The pretreatment will, by itself, produce a small degree of shrink-resistance in the wool.

The wool is subjected to antichlorination treatment with sulphite and rinsed and is then ready for the polymer application stage.

Turning now to the polymer treatment which characterises the method of this invention, this comprises two components. The first is an amino functional polymer which by itself is capable of conferring a degree of shrink resistance to the wool. This polymer contains reactive groups such that it can be applied to the wool and will form a film on the surface of the wool fibres. The polymer could be of a type which is not normally regarded as suitable for use as a shrink resist agent perhaps, for example, because of a lack of sufficient mechanical strength to withstand the operation necessary to convert wool top into yarn.

The second polymer component is a silicone polymer which is capable of reacting with the reactive groupings of the amino functional polymer component. The silicone polymer should be capable of exhausting onto the wool fibre under the conditions of application herein described, or be capable of being made of exhaust onto the wool upon the addition of various conventional exhaustion aids.

Suitable amino function polymers for use in the method of this invention include the reactive cationic polymers formed, for example, by reaction of:

i) precursor amine-containing polymers such as: amino amides produced by reacting di- or polyfunctional acids with polyamines containing three or more amino groups; condensation polymers produced by reacting dicyandiamide and polyamines containing three or more amino groups; polyethylene imine; addition polymers, such as may be prepared from ethylene oxide, acrylic acid and its derivatives or acrylo nitrile, into which amino functional groups have been introduced by subsequent reaction or by copolymerisation of a suitable comonomer already bearing an amino functional group; and ii) di or polyfunctional reactive species such as: epichlorohydrin; di or polyepoxy compounds such as bisphenol A resin: polyhalogenated hydrocarbons; reactive short chain amine/epichlorohydrin prepolymers. Suitable polymers of the latter type are described in British Patent No. 1,213,745.

While such polymers will normally be applied to the wool as aqueous solutions, it is to be understood that aqueous dispersions of polymers may also be used provided that they are capable of forming a suitable coating on the wool fibre.

Suitable silicone polymers for use in the method of this invention are those bearing groups capable of reacting with the reacting groups present on the amino functional polymer component under the conditions of processing, and which are also capable of being exhausted onto wool fibres under these conditions or upon the addition of exhaustion aids. The silicone polymers will normally be aqueous dispersions or emulsions, occasionally microemulsions, stabilised by suitable surfactant systems which confer a certain ionicity to the droplets in some cases. Nonionic, cationic and anionic systems may be employed as long as the ionicity of the surfactant used to stabilise the emulsion does not interfere with the exhaustion of the silicone onto fibre and the subsequent reaction between the two polymer films.

Suitable silicone polymers include those bearing amino, thiol or epoxy functional groups. Examples of such polymers are as follows:

i) Amino functional silicone polymers

Ucarsil Magnasoft, Magnasoft Microemulsion TP 202 (Union Carbide).

VP 1019, VP 1441E, VP 1460E, Vp 1657E (Wacker Chemicals).

Crosil R (Crossfield Textile Chemicals).

Ultratex TC 661, Ultratex ESU (Ciba Geigy).

ii) Thio functional silicone polymers

Tegosevin 503/9 (Goldschmidt).

SLM 42 235/3, SLM 42 235/4 (Wacker Chemicals).

iii) Epoxy functional silicone polymers

Ucarsil TE-24, Ucarsil SFT (Union Carbide).

The use of the silicone polymer VP 1445E is particularly preferred.

The oxidative pretreatment of the wool may be performed at various stages in its processing, such as before or after the spinning, knitting, weaving or printing operations. The polymer treatment may either be carried out immediately following the oxidative pretreatment of the wool, or subsequently at a much later stage in the processing of the wool. Thus, for example, dry pretreated top may be rewetted and treated with the two polymers before or after dyeing in top form, or may be spun into yarn and treated during the yarn dyeing operation, or may be knitted or woven into fabric or made up into garments and treated in this form.

The two polymers may either be applied together from one bath (co-application) or from two successive baths (post application). In the latter case, drying of the wool should not be allowed to occur between the baths. If a post-application procedure is adopted, the silicone polymer is applied after the amino functional polymer. For application purposes, the two polymers may be incorporated, together or individually, into formulations containing other ingredients such as fibre lubricants. They may also contain other materials, for example, antistatic agents either as a formulated mixture for as a modification to the polymer system. In particular, it has been noticed that the two polymer system of the present invention appears to "lock in" conventional antistatic agents to the film surface on the wool fibres in such a way that, while retaining their beneficial properties, the usual adverse effects that these agents have on rub fastness are substantially avoided. The two polymers may also be formulated together for application purposes if practicable.

With regard to the proportions to be used of the two polymer components, the amino functional polymer will normally be present in the major amount. Where the amino functional polymer is self-crosslinking, reactive groups not involved in reacting with the silicone polymer will be available for reaction with other groupings in the amino functional polymer. Occasionally, the silicone polymer component may be present in the major amount. If the silicon resin is used in an amount substantially greater than that which is capable of reacting with the amino functional polymer component, however, this can have a deleterious effect and result in poor rub fastness.

The total amount of polymer solids applied to the wool fibre in the method of this invention is generally from 0.005% to 10% by weight of the wool fibre, most preferably from 0.05% to 2.0%.

Following the polymer treatment, the wool is dried and may then be further processed in the usual manner.

It has surprisingly been found that treatment of wool with an amino functional polymer and a silicone polymer, subsequent to an oxidative pretreatment, produces a degree of shrink resistance which is superior to that achieved by the application of either polymer alone. However, the method of this invention produces other advantages too. It has been found that, using the method, a very high degree of rub fastness can be achieved with even the most difficult dyestuffs. Further, a greatly enhanced handle of the wool is produced. The fibres are softer and this softness has been found to be permanent, surviving all subsequent dyeing operations. There is thus no need to use an additional softening agent.

A still further advantage of the present method is that the use of the components as hereinbefore defined results in a high speed cure at relatively high moisture content. The soft handle and rub fastness shown by wool which has been treated by this method is believed to be largely derived from the silicone polymer component. It has been found, for example, that in the case of amino amide polymers of the type described in U.S. Pat. No. 2,926,154, a film produced by applying 2% on weight of wool of the polymer is rendered substantially softer by incorporation of 0.125% on weight of wool (o.w.w.) of an amino functional silicone polymer, without loss of shrink resistance.

Using the method of the present invention enables the polymer treatment to be performed on undyed wool. The wool is not dyed until after the two components of the polymer treatment have been applied, and this is an advantageous dyeing procedure. It is believed that there may be some reduction in the rate of dye uptake by the wool fibres in the early stages of the dyeing operation (i.e. a reduced "rate of strike") and this should improve the ability to achieve level dyeing. This is considered to be an important advantage of the method of this invention, particularly since, when wool is dyed in the form of yarns of garments, unlevel dyeing cannot readily be corrected during subsequent processing. Furthermore, wool tops which have been subjected to conventional shrink-resist treatments have a tendency, upon dyeing, to become hard and caked. This can lead to difficulties in subsequent processing of the wool. It has been found as an additional advantage of the method of this invention that wool tops, thus treated, remain open and springy even after dyeing.

The method of this invention may be operated as either a continuous process or a batch process and may be performed at any stage in the processing of wool to produce a finished article.

The present invention will now be illustrated by the following Examples, which are included solely for the purposes of illustration and are in no way intended to be limiting. All parts and percentages are by weight.

EXAMPLE 1: PRETREATMENT OF WOOL TOP

Samples of 70s quality dry combed wool top were obtained commercially or prepared on commercial machinery using the following conventional oxidative pretreatment methods:

(A) Padding a solution containing 2.0% o.w.w. disodium dichloroisocyanurate and 1.0% o.w.w. potassium permonosulphate onto the wool top and subsequently passing through an antichlor bath containing sodium sulphite, according to the general procedure disclosed in British Patent No. 1,073,441.

(B) Padding a solution containing 1.5% o.w.w. active chlorine from sodium hypochlorite and 1.5% o.w.w. potassium permanganate onto the wool top and subsequently passing through an antichlor bath containing acidified sodium bisulphite, according to the general procedure disclosed in British Patent No. 2,044,310.

(C) Passing the wool top through a machine containing 1.5% o.w.w. chlorine gas in aqueous solution followed by passing through an antichlor bath containing sodium sulphite, according to the general procedure disclosed in U.S. Pat. No. 2,671,006.

The samples of yarn were then spun into 2/24s worsted count yarn and knitted into swatches with a cover factor of 1.29 direct tax. The prepared swatches were then scoured in aqueous non-ionic detergent and rinsed thoroughly.

EXAMPLE 2: PRETREATMENT OF SWATCHES

Knitted swatches were prepared from 2/24s worsted count wool yarn spun form 70s quality dry combed top and knitted to cover factor 1.29 direct tax.

The following oxidative treatments were applied to the swatches:

(A) Disodium dichloroisocyanurate 3.5% o.w.w. at liquor ratio 30:1 and pH 3.5 using formic acid followed by an antichlor bath containing 6.25% o.w.w. sodium sulphite.

(B) Potassium permonosulphate 4.5% o.w.w. at liquor ratio 30:1 and pH 4.0 using formic acid followed by a neutralising bath containing 5.0% sodium sulphite.

The treated swatches were then rinsed thoroughly.

EXAMPLE 3: PREPARATION AND SELECTION OF POLYMERS

Polymer 3A

A partially crosslinked polyaminoamide polymer was prepared according to the following three-stage synthesis:

i) Reaction of a dicarboxylic acid with a polyalkylene polyamine 109 kg (1.06 kg mol) of diethylenetriamine are diluted with 40 kg of water in a vessel provided with a stirrer while applying external cooling in such a way that the internal temperature remains below 70° C. Thereafter 146 kg (1.00 kg mol) of powdered adipic acid are added sufficiently slowly for the inner temperature to be maintained at 50°-90° C. by external cooling. The vessel with stirrer is closed and provided with a factionating column which is joined to a descending cooler. Thereafter, during 1 hour, heating to 120°-130° C. by means of an oil bath under an atmosphere of nitrogen is effected followed by heating during 6 hours to an internal temperature of 170°-175° C. The water used for dissolution and that which results during the condensation is thus distilled off through the column, but less than 0.4 kg of diethylenetriamine is entrained in this way by the water vapour. Stirring is continued for a further 3 hours at 170°-175° C. and the column with the descending cooler is then replaced with a reflux condenser. After cooling to 150°-160° C., 219 kg of water are added in such a way that the inside temperature gradually falls to 100°-105° C. under continuous reflux. Boiling is continued for one hour under reflux; after cooling, a clear solution of the intermediate product is obtained which contains 50% of solid substance.

ii) Production of the bifunctional agent 205.5 kg of ice are mixed with 112.5 kg of 40% dimethylamine solution (1 kg mol) in a vessel of stainless steel provided with a stirrer and 100 kg of a 36.5% hydrochloric acid solution (1 kg mol) are added in such a way that the inner temperature remains below 25° C. A solution of dimethylammonium chloride of pH value 4-7 results. A further 112.5 kg of a 40% dimethylamine solution (1 kg mol) are added and then 277.5 kg of epichlorohydrin are run in sufficiently slowly so that the internal temperature can be kept at 28°-32° C. by external cooling. The reaction is allowed to go to completion at this temperature for a few hours and a clear solution results which contains 50% of cross-linking agent of sufficient purity of the formula:

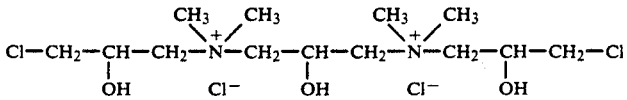

iii) Reaction of the products from steps i) and ii)

10 kg of the 50% product solution of step i) are mixed with 2.52 kg of the 50% bifunctional agent solution obtained in step ii) and with 8.38 kg of water in a heatable vessel provided with stirrer. While stirring well, heating is effected for 1 hour to 90° C. in an atmosphere of nitrogen and that temperature is maintained for 2 hours. After cooling, a 30%, clear, fairly viscous solution of a cross-linked, cationically active polyamide is obtained.

This product was then reacted with 0.5 equivalents of hydrochloric acid and 0.5 equivalents of epichlorohydrin in the following manner:

875 kg of the polymer (26% solids) are placed in a suitable reactor. 49.4 kg of hydrochloric acid (30% strength) are diluted in 38 kg of water. The diluted hydrochloric acid solution is then added to the polymer and thoroughly mixed with stirring. The temperature is maintained at about 25° C. (but not less than 20° C.). Stirring is continued throughout the reaction. 37.6 kg of epichlorohydrin are then added to the acidified polymer solution and the mixture stirred at ambient temperature for a further 24 hours. The resultant polyamide is stabilised with formic acid to a pH of 3.5±0.1 (as measured on a 5% solids solution). Resultant polymer solid was 25%.

Polymer 3B

A partially crosslinked polyaminoamide polymer was prepared according to steps i), ii) and iii) of the procedure for Polymer 3A.

This product is then reacted with 0.5 equivalents of epichlorohydrin in the following manner:

875 kg of the polymer (26% solids) are placed in a suitable reactor. 87.4 kg of water are added and thoroughly mixed with stirring. The temperature is maintained at about 25° C. Stirring is continued throughout the reaction. 37.6 kg of epichlorohydrin are then added to the polymer solution and the mixture stirred at ambient temperature for a further 24 hours. Care must be taken to ensure that the temperature does not exceed about 25° C. during this period. The resultant polyamide is stabilised with formic acid to a pH of 3.5±0.1 (as measured in a 5% solids solution). Resultant polymer solids was 25%.

Polymer 3C

A polyaminoamide polymer was prepared from diethylene triamine and adipic acid according to step i) of the procedure for Polymer 3A.

This product was then reacted with 1.0 equivalent of epichlorohydrin for 12 hours at ambient temperature, then for 1.5 hours at 75° C. Resultant polymer solids was 25%.

Polymer 3D

Hercosett 125

Hercosett 125 is a commercially available polyaminoamide polymer (prepared from diethylene triamine and adipic acid) react ed with epichlorohydrin. Polymer solids content is 12.5%.

Polymer 3E

A copolymer was prepared from 3.0 moles of methyl methacrylate and 1.0 mole of 2-(dimethylamino) ethyl methacrylate and reacted with 1.0 mole of epichlorohydrin in the manner described in our European Patent Application No. 0129322. Final polymer solids content was 30%.

Polymer 3F

VP 1444E

VP 1444E is a commercially available poly(dimethylsiloxane) α, W diol emulsion which is sold by Wacker Chemicals. Polymer solids contents is 50%.

Polymer 3G

VP 1445E

VP 1445E is a commercially available poly(dimethylsiloxane) α, W diol emulsion which contains reactive alkyl amino side groups. VP 1445E is sold by Wacker Chemicals. Polymer solids content is 35%.

EXAMPLE 4: APPLICATION OF POLYMERS TO SWATCHES

The method of application is illustrated by reference to Polymers 3A and 3G.

General Preparation Procedure for Polymer Application

Knitted swatches prepared as described in Examples 1 and 2 were stirred in a water bath (liquor to goods ratio 30:1, temperature of 25° C.) at a pH of 8.0 for 5 minutes to wet out and equilibrate the swatches.

Swatches were stirred throughout each application and maintained at the stipulated pH.

4A: Application of Polymer 3A only

8% (2% solids) on weight of goods of Polymer 3A pre-diluted with water (approximately 1 part polymer to 20 parts water) was drip fed over 10 minutes into the water bath containing the swatches. After a further 5 minutes the temperature was raised to 40° C. and stirring continued until the polymer had exhausted completely onto the swatches. (Tested for exhaustion by removing a 50 ml aliquot of the liquor from the bath and adding 1 ml of a 1% solution of Arylan SBC 25—an anionic surfactant sold by Lankro Chemicals. A turbid result indicates polymer is still in bath. A clear result indicates the polymer has exhausted.) The swatches were then hydroextracted and tumble dried.

4B: Application of Polymer 3A in conjunction with Polymer 3G (i.e. co-application)

8% of Polymer 3A and 0.5% of Polymer 3G on weight of goods, prediluted with water (in the same vessel) were drip fed over 10 minutes into the water bath containing the swatches. After a further 5 minutes the temperature was raised to 40° C. and stirring continued until the polymers had exhausted completely onto the swatches. The swatches were then hydroextracted and tumble dried.

4C: Application of Polymer 3A followed by Polymer 3G (i.e. post-application)

8% of Polymer 3A was applied as in section 4A. However after exhausting the polymer the bath liquor was discarded and a fresh bath set up at pH 7.0. 0.5% Polymer 3G pre-diluted with water (approximately 1 part polymer to 20 parts water) was drip fed over 5 minutes. After a further 5 minutes the temperature was raised to 40° C. and stirring continued until the polymer had exhausted onto the swatches. The swatches were then hydroextracted and tumble dried.

4D: Application of Polymer 3A in conjunction with Polymer 3G and followed by Polymer 3G (i.e. combined co-application and post application)

8% of Polymer 3A and 0.25% Polymer 3G were applied as in section 4B. However after exhausting the polymers the bath liquor was discarded and a fresh bath set up at pH 7.0. 0.25% Polymer 3G pre-diluted with water, was drip fed over 5 minutes. After a further 5 minutes the temperature was raised to 40° C. and stirring continued until the polymer had exhausted onto the swatches. The swatches were then hydroextracted and tumble dried.

In addition to the four methods of polymer application, illustrated in sections 4A to 4D, polymers were also applied followed by Alcamine CA New—a commercial softening agent frequently used in the continuous shrink proofing of wool tops. The method of application is illustrated by the following example.

4E: Application of Polymer 3A followed by Alcamine CA New

8% of Polymer 3A was applied as in section 4A. However after exhausting the polymer the bath liquor was discarded and a fresh bath set up at pH 7.0. 0.5% Alcamine CA New, pre-diluted with water, was drip fed over 5 minutes. After a further 5 minutes the temperature was raised to 40° C. and stirring continued until the softener had exhausted onto the swatches. The swatches were then hydroextracted and tumble dried.

EXAMPLE 5: CO-APPLICATION

Pairs of swatches were prepared according to the procedures outlined in Examples 1 and 2 above, then treated according to the procedures outlined in Examples 4A and 4B above except that the amount of Silicone Polymer 3G was varied as shown below. One pair of untreated swatches was retained as control.

One of each pair of swatches was then dyed using a mixture of Lanasol Red 2G (3oww) and Lanasol Red G (1% oww) at pH 6.0 buffered with Sodium acetate and using Albegal B as levelling agent. Dyed swatches were evaluated for rub fastness according to BS 1006 (1978) X12 with the following results (5=best, 1=worst).

| Pretreat according to Example | Pretreat only | Prepared as Example 4A | Prepared as Example 4B using the following amount of Polymer 3G (% oww) 0.25 | 0.5 | 1.0 | Prepared as Example 4E |
|---|---|---|---|---|---|---|
| 1A | 4 | 3 | 3 | 3–4 | 4–5 | — |
| 1C (1) | 4–5 | 3 | 3–4 | 4 | 4 | — |
| 1C (2) | 3 | 3 | 3 | 3 | 3 | — |
| 2A | 4 | 4 | 4–5 | 4–5 | — | 4 |
| 2B | 3–4 | 2–3 | 2–3 | 2–3 | 3 | — |

EXAMPLE 6: POST APPLICATION

Pairs of treated swatches dyed and ecru were prepared according to the general procedure described in Example 5 except that the polymer application procedures outlined in Examples 4A and 4C above were used.

Wet rub fastness results were as follows:

| Pretreat according to Example | Pretreat only | Prepared as Example 4A | Prepared as Example 4C using the following amount of Polymer 3G (% oww) 0.25 | 0.5 | 1.0 | Prepared as example 4E |
|---|---|---|---|---|---|---|
| 1A | 4 | 3 | 3–4 | 3–4 | 4 | |
| 1B | 4 | 2–3 | 4 | 3 | | 2–3 |
| 1C (1) | 4–5 | 3 | 4 | 4–5 | 4–5 | |
| 1C (2) | 3 | 3 | 4 | 4–5 | 4 | |
| 2A | 4 | 4 | 4–5 | 4–5 | — | 4 |
| 2B | 3–4 | 2–3 | 3 | 3–4 | 4 | |

EXAMPLE 7: CO- AND POST-APPLICATION

Pairs of treated swatches dyed and ecru were prepared according to the general procedure described in Example 5 except that the polymer application procedures outlined in Examples 4A and 4D above were used.

Wet rub fastness results were as follows:

| Pretreat according to Example | Pretreat only | Prepared as Example 4A | Prepared as Example 4D but using the following amount of Polymer 3G (% oww) Co applied 0.25 Post applied 0.25 | Co applied 0.5 Post applied 0.5 |
|---|---|---|---|---|
| 1B | 4 | 2–3 | 3 | 3–4 |
| 2A | 4 | 4 | 4 | 4 |

EXAMPLE 8: EVALUATION OF VARIOUS POLYMERS

Pairs of treated swatches were prepared according to the general procedure described in Example 5, 6 and 7 except that the pretreat described in Example 1C was used throughout, and various different shrink resist polymers described in Example 3 were used in place of the Polymer of example 3C.

Wet rub fastness results obtained were as follows:

| Treatment as Examples | Amount of Polymer 3G % oww) | Pretreat as Example 1A ecru | 1A dyed | 1B ecru | 1B dyed | 2A ecru | 2A dyed | 2B dyed |
|---|---|---|---|---|---|---|---|---|
| Pretreat | — | 7 | 3 | 7= | 8 | 4= | 5 | 2 |
| 4A | — | 8 | 8 | 9 | 9 | 8 | 9 | 6= |
| 4B | 0.25 | 6 | 7 | 7= | 7 | 7 | 6 | 8 |
| | 0.5 | 5 | 6 | 3= | 5 | 6 | 7 | 6= |
| 4C | 0.25 | 4 | 5 | 1 | 1 | 4= | 4 | 4 |
| | 0.5 | 1= | 2 | 3= | 2 | 1= | 3 | 1 |
| 4D | 0.25 co-applied + 0.25 post applied | 1= | 1 | 3= | 4 | 3 | 2 | 3 |
| | 0.5 co-applied + 0.5 post applied | 1= | 4 | 2 | 3 | 1= | 1 | 5 |
| 4E | — | — | — | 6 | 6 | | 8 | — |

| Treatment as Example | Amount of Polymer 3G % oww | Polymer as Example 3A | 3B | 3E |
|---|---|---|---|---|
| | Pretreat only | 3 | 3 | 3 |
| 4A | — | 3 | 3 | 2-3 |
| 4B | 0.25 | 3 | 4-5 | — |
| | 0.5 | 4-5 | 3-4 | — |
| | 1.0 | — | — | 4 |
| 4C | 0.25 | 3 | 4-5 | — |
| | 0.5 | 4-5 | 4-5 | — |
| | 1.0 | — | — | 4 |
| 4D | Co-applied 0.25 + Post applied 0.25 | 4-5 | 4 | — |
| | Co-applied 0.5 + Post applied 0.5 | 3 | 4-5 | — |
| 4E | — | 2-3 | 4 | — |

EXAMPLE 9: EFFECT OF DIFFERENT DYESTUFF CLASSES

Treated swatches were prepared according to the general procedures described in Examples 5, 6 and 7 using the pretreat described in Example 1C, but dyed with Acidol Olive at 2% oww (4% Dylachem Leveller LNC at pH 5.0 with acetic acid reduced at the boil to pH 4.5 with formic acid, then after chromed with 1.5% oww potassium dichromate) or Azurol Blue at 4% oww (pH 5.5 with acetic acid, 2% Dylachem Leveller PLA and 2% ammonium acetate followed by soaping off at 50° C. with 1% oww ammonia (s.g. 0.880) and 1% oww Kieralon D).

Wet rub fastness results were as follows:

| Treatment as Example | Amount of Polymer 3G % oww | Dyestuff Acidol Olive | Azurol Blue |
|---|---|---|---|
| Pretreat | — | 4-5 | 3 |
| 4A | — | 4-5 | 3 |
| 4B | 0.25 | 5 | 3-4 |
| | 0.5 | 4-5 | 3-4 |
| | 1.0 | 5 | 4 |
| 4C | 0.25 | 4-5 | 4-5 |
| | 0.5 | 5 | 4-5 |
| | 1.0 | 5 | 5 |

EXAMPLE 10: HANDLE ASSESSMENT

Dyed and ecru swatches from Examples 5, 6 and 7 were evaluated for handle as follows: various assessors were provided with coded swatches and asked to rank these in order of preference for softness. The various rankings were then added together to provide an overall numerical ranking of the swatches. The rankings obtained are shown below (1=best, 9=worst).

In a similar manner, the swatches prepared according to Example 8 were evaluated for handle with the following results.

| Treatment as Examples | Amount of Polymer 3G (% oww) | Pretreat as Example 3A ecru | 3A dyed | 3B ecru | 3B dyed |
|---|---|---|---|---|---|
| 4A | — | 8 | 8 | 8 | 8 |
| 4B | 0.25 | 7 | 7 | 7 | 6= |
| | 0.5 | 3= | 4 | 4= | 6= |
| 4C | 0.25 | 3= | 2 | 1 | 2 |
| | 0.5 | 6 | 1 | 6 | 5 |
| 4D | Co-applied 0.25 + post applied 0.25 | 1 | 3 | 4= | 3 |
| | Co-applied 0.5 + post applied 0.5 | 2 | 5 | 2 | 1 |
| 4E | — | 5 | 6 | 3 | 4 |

EXAMPLE 11: EVALUATION OF SHRINK RESISTANCE

As a measure of shrink resistance dyed swatches treated according to Examples 5, 6 and 7 on pretreated swatches prepared as in example 1C were washed according to the test method TM31 of the International Wool Secretariat i.e. 1×7A wash cycle plus 5×5A wash cycles. In order to evaluate durability of the treatment, the swatches were then subjected to repeated 5×5A wash cycles with the following results (negative values indicate shrinkage, positive results indicate extension).

| Treated According to Example | Amount of Polymer 3G (% oww) | % Area Change after - 7A | 5 × 5A | 10 × 5A | 15 × 5A |
|---|---|---|---|---|---|
| Pretreat | — | −0.4 | −30.2 | −46.6 | −51.0 |
| 4A | — | +1.9 | −6.8 | −5.8 | −10.6 |
| 4B | 0.25 | +0.8 | −4.6 | −3.8 | −6.7 |
| | 0.5 | −1.1 | −4.5 | −3.5 | −7.0 |
| | 1.0 | −1.9 | −3.0 | −4.5 | −1.3 |
| 4C | 0.25 | −0.2 | −3.8 | −4.6 | −10.4 |
| | 0.5 | +0.6 | −4.7 | −4.1 | −8.0 |
| | 1.0 | +0.1 | −4.3 | −3.2 | −6.7 |

EXAMPLE 12: EVALUATION OF VARIOUS SILICONE EMULSIONS

Various silicone emulsions were applied to pairs of wool swatches according to the procedure outlined in example 4C, except that instead of the polymer 3G from example 3, the following silicone emulsions were used:

| | |
|---|---|
| Ucarsil Magnasoft | (Union Carbide) |
| Magnasoft Microemulsion TP202 | (Union Carbide) |
| Ultratex ESU | (Ciba Geigy) |
| Tegosevin 503/9 | (Th. Goldschmidt) |
| VP 1487E | (Wacker Chemicals) |

A further series of pairs of swatches were also treated as outlined above except that polymer 3D was used instead of polymer 3A, and instead of polymer 3G, the following products were used.

| | |
|---|---|
| Ucarsil Magnasoft | (Union Carbide) |
| Tegosevin 503/9 | (Th. Goldschmidt) |
| SLM 42235/3 | (Wacker Chemicals) |
| Ucarsil TE-24 | (Union Carbide) |

In all the above cases, a satisfactory deposition of polymer was achieved except with Ucarsil TE-24. In this case, the addition of 0.5% oww of Polymer 3A was added to the bath and resulted in exhaustion of the polymer.

A further pair of swatches was then treated according to example 4B and Polymer 3G was replaced by Ucarsil TE-24. A more satisfactory degree of exhaustion was then obtained.

One of each pair of the resulting swatches was then dyed according to the dyeing procedure described in Example 5, and the dyed swatches evaluated as described in example 5. Handle assessments and shrinkage tests were also conducted on both dyed and ecru swatches as described in Example 10 and 11 respectively.

Similar results were obtained to those found from Examples 5–11 inclusive.

EXAMPLE 13: COMPATIBILITY WITH ANTISTATIC AGENTS

In some cases where modern high-speed gilling machines are employed, it was expected that some degree of static control would be needed to avoid excessive static buildup. Formulations were thus produced by cold mixing of the various commercial substantive antistat products with selected silicone emulsions as follows:

| | VP 1445E | Ucarsil Magnasoft | Tegpsivin 503/9 |
|---|---|---|---|
| Alcostat PB25 (Allied Colloids) (see Note 1) | mixture 1:1 by weight gave a pasty, stable mixture | — | 2 parts of PB25 mixed with 1 part 503/9 gave a viscous, stable liquid |
| Zerostat C (Ciba Geigy) (see Note 1) | mixture 1:1 by weight gave a slightly viscous stable mixture | | |
| Ceranine PNP (Sandoz) | mixture 1:1 by weight gave a mobile, stable liquid | mixture 1:1 by weight gave a mobile, stable liquid | mixture 1:1 by weight gave a mobile stable liquid |
| Elfugin PF liquid (Sandoz) | mixture of 2 parts PF to 1 part 1445E gave a creamy stable mixture | mixture of 2 parts PF to 1 part 1445E gave a creamy stable mixture | |
| Imidazoline (see Note 3) | a 1:1 mixture by weight gave a slightly viscose stable liquid | a 1:1 mixture by weight gave a slightly viscose stable liquid | a 1:1 mixture by weight gave a viscous stable liquid |

These mixtures, when evaluated as described in example 12 gave similar results to those obtained from earlier examples.

Note 1: a dilution of 30 parts of commercial product with 70 parts of deionised water, mixed at room temperature was used in these preparations.

Note 2: a dilution 1:1 as note 1 was used.

Note 3: a 10% dispersion in water of an unsaturated C17 imidazoline methosulphate quaternary amine—Imidazoline 180H from Lakeland Laboratories Ltd.

EXAMPLE 14

1000 kg of 21.5 micron quality wool top was treated in a 5 bowl suction drum backwasher fitted with 3 section suction drum dryer at 6 m/min at a rate of 230 kg/hour. The processing sequence comprised:

bowl 1—acid hypochlorite chlorination at 2% available Chlorine o.w.w.

bowl 2—antichlorination with sodium sulphite 0.8% o.w.w. at pH 9.4 bowl 3—fresh water rinse bowl 4—Polymer of example 3D applied at 2% solids o.w.w. (16% o.w.w. product) and pH 7.6.

bowl 5—Polymer of example 3C applied at 0.3% o.w.w. product at pH 6.8.

The final bowl was milky in appearance on startup but rapidly cleared and remained clear throughout the trial. The dryer temperature was maintained at 60°–65° C. whilst still giving dry slivers and adequate curing the resin. The handle of the slivers produced was considerably softer than normally obtained with the usual softener used in this plant. Gilling was performed immediately the slivers emerged from the dryer, and a noticeable improvement in ease of running was noted.

Two 500 kg dyeings were then performed in a top dyeing machine using the normal procedures for the wool treated using conventional softener. One dyeing using a reactive dyestuff gave a wet rub fastness of 4 as compared with 3 for wool treated with conventional softener. The second dyeing using a chrome dyestuff gave a fastness of 4 as normally experienced on this quality.

After dyeing the tops were radio frequency dried. Conventionally softened wool produced compacted, hard, matted, solid tops from this procedure. In contrast, wool from both dye batches was as free and voluminous as the undyed wool. Subsequent gilling proceeded very smoothly and resulted in a very even sliver weight which gave considerably fewer end breaks during spinning, than normally experienced. The handle of the treated wool remained soft throughout all processing and produced no residues in the spinning machinery.

EXAMPLE 15

5000 kg of 28 micron wool top was treated in a 4 bowl backwasher fitted with a 3 section suction drum dryer at 8 m/min at a rate of 388 kg/hour. Prior to the backwasher, the wool was passed through a horizontal pad where it was treated with a mixture of 1.5% o.w.w. available chlorine from sodium hypochlorite and 1.5% o.w.w. potassium permanganate as outlined in British Patent 2044310 (the Dylan Fullwsh process) and thereafter treated with antichlor and rinsed as described in said patent. In the final backwasher bowl, the wool was then treated with a mixture comprising 0.5% o.w.w. of the polymer of example 3A.

The wool slivers produced were soft and open and remained so after top dyeing to various shades with a variety of dyestuff types. Improvements in rub fastness and a consistent improvement of gilling and spinning performance was noted.

EXAMPLE 16

100 kg of 22 micron wool top was treated by passing into a Kroy chlorination machine (as per British Patent No. 2671006) then through a 5 bowl suction drum backwasher and a 4 section suction drum dryer. The bowls were set as follows:

bowl 1—antichlor with sodium metabisulphite
bowl 1—neutralisation with sodium carbonate pH 9.2
bowl 3—rinse
bowl 4—A mixture of 0.1% of Polymer from example 3A and 0.5% of polymer from example 3G.

Again, a soft, open top was produced giving good performance in gilling, top dyeing and spinning.

We claim:

1. A method for the treatment of wool so as to impart shrink resistance comprising the steps of A. subjecting the wool to an oxidative pretreatment, and B. subsequently treating the wool with (1) an amino functional polymer which itself confers a degree of shrink resistance and (2) a silicone polymer bearing amine, thiol or epoxy functional groups capable of reacting with the reactive groups of the amino functional polymer, said polymers (1) and (2) being applied either in the same step or in successive steps, the total amount of said polymer solids applied to the wool fibers from 0.005 to 10% on the weight of the wool said amino functional polymer is produced by reacting (a) precursor amine-containing polymers selected from the group consisting of amino amides produced by reacting di- or poly functional acids with polyamines containing three or more amino groups; condensation polymers produced by reacting dicyandiamide and polyamines containing three or more amino groups; polyethylene imine; and addition polymers, prepared from ethylene oxide, acrylic acid, and acrylonitrile, into which amino functional groups have been introduced by subsequent reaction or by copolymerisation of a suitable comonomer already bearing an amino functional group; with (b) di or polyfunctional reactive species selected from the group consisting of epichlorohydrin; di- or polyethoxy compounds polyhalogenated hydrocarbons; and short chain amine-epichlorohydrin prepolymers.

2. The method as claimed in claim 1, wherein the oxidative pretreatment is a chlorination treatment.

3. The method as claimed in claim 1, wherein the amino functional polymer is used in a major proportion and the silicone polymer is used in a minor proportion.

4. The method as claimed in claim 1, wherein the amino functional polymer and the silicone polymer are applied to the wool together.

5. The method as claimed in claim 1, wherein the amino functional polymer is applied to the wool before the silicone polymer.

6. The method as claimed in claim 1, wherein the amino functional polymer and the silicone polymer are applied to the wool in a combination of co-application and post-application techniques.

7. The method as claimed in claim 1, wherein the total amount of polymer solids applied to the wool fibres is from 0.05% to 2.0% on the weight of wool.

8. The method as claimed in claim 1, which is in the form of a continuous process.

9. The method as claimed in claim 1, which is in the form of a batch process.

* * * * *